US006250074B1

(12) United States Patent
Suzuki et al.

(10) Patent No.: US 6,250,074 B1
(45) Date of Patent: Jun. 26, 2001

(54) AIR-FUEL RATIO CONTROL APPARATUS AND METHOD OF INTERNAL COMBUSTION ENGINE

(75) Inventors: Naoto Suzuki, Fujinomiya; Hiroshi Tanaka, Susono, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/561,799

(22) Filed: May 1, 2000

(30) Foreign Application Priority Data

May 10, 1999 (JP) ..... 11-128686

(51) Int. Cl.[7] ..... F01N 3/00

(52) U.S. Cl. ..... 60/285; 60/286; 60/301; 60/276; 60/297; 123/443

(58) Field of Search ..... 60/285, 286, 276, 60/295, 297, 300, 274, 301; 123/443, 691

(56) References Cited

U.S. PATENT DOCUMENTS

| | | | | |
|---|---|---|---|---|
| 5,207,057 | * | 5/1993 | Kayanuma | 60/276 |
| 5,233,829 | * | 8/1993 | Komatsu | 60/276 |
| 5,417,058 | * | 5/1995 | Shimizu | 60/276 |
| 5,657,625 | | 8/1997 | Koga et al. . | |
| 5,970,707 | * | 10/1999 | Sawada et al. | 60/277 |
| 6,014,859 | * | 1/2000 | Yoahizaki et al. | 60/285 |

FOREIGN PATENT DOCUMENTS

| | | |
|---|---|---|
| 43 10 145 | 4/1994 | (DE) . |
| 0 159 734 | 10/1985 | (EP) . |
| 0 861 972 | 9/1998 | (EP) . |
| 1-315633 | 12/1989 | (JP) . |
| 02 001439 | 1/1990 | (JP) . |
| 2-001439 | 1/1990 | (JP) . |
| 8-61052 | 9/1994 | (JP) . |

OTHER PUBLICATIONS

European Search Report for EP 00 10 9794.

* cited by examiner

*Primary Examiner*—Thomas Denion
*Assistant Examiner*—Binh Tran
(74) *Attorney, Agent, or Firm*—Kenyon & Kenyon

(57) ABSTRACT

First and second cylinder groups are connected to a NOx absorbent via a confluent exhaust pipe. The target values of the air-fuel ratio of exhaust gas from the first cylinder group and the second cylinder group are set to a relatively rich value and a relatively lean value, respectively. The target values of the air-fuel ratio of exhaust gas from the first and second cylinder groups are set so that the influent exhaust gas average air-fuel ratio entering the NOx absorbent becomes equal to a relatively slightly rich value. HC in exhaust gas from the first cylinder group and oxygen in exhaust gas from the second cylinder group react in the NOx absorbent to heat the NOx absorbent and cause the NOx absorbent to release SOx. Based on an output signal of an air-fuel ratio sensor disposed downstream of the NOx absorbent, the amounts of fuel to be injected to the first and second cylinder groups are controlled so that the influent exhaust gas average air-fuel ratio becomes equal to its target value.

20 Claims, 12 Drawing Sheets

AIR-FUEL RATIO CONTROL APPARATUS AND METHOD OF INTERNAL COMBUSTION ENGINE

INCORPORATION BY REFERENCE

The disclosure of Japanese Patent Application No. HEI 11-128686 filed on May 10, 1999 including the specification, drawings and abstract is incorporated herein by reference in its entirety.

BACKGROUND OF THE INVENTION

1. Field of the Invention

The present invention relates to an air-fuel ratio control apparatus and an air-fuel ratio control method for an internal combustion engine. More particularly, the invention relates to air-fuel ratio control apparatus and method for an internal combustion engine for controlling an influent exhaust gas average air-fuel ratio to a target value.

2. Description of the Related Art

The ratio of the total amount of air to the total amount of reducing agents and fuel supplied into an intake passage, a combustion chambers and a portion of an exhaust passage extending upstream of a given location in the exhaust passage is termed the air-fuel ratio of exhaust gas passing by the location. As a related technology, internal combustion engines are known which are designed to burn a lean air-fuel mixture and which have in exhaust passages thereof NOx absorbents that absorb NOx when the air-fuel ratio of influent exhaust gas is on a leaner than a theoretical air-fuel ratio and that release absorbed NOx when the oxygen concentration in influent exhaust gas decreases to or below a certain level. In these internal combustion engines, the air-fuel ratio of exhaust gas flowing into the NOx absorbent is temporarily shifted to the richer side of the theoretical air-fuel ratio to release NOx from the NOx absorbent. The released NOx is then reduced.

However, since the fuel and lubricants used in internal combustion engines contain sulfuric substances, exhaust gas from these engines contains sulfuric substances, for example, SOx or the like. SOx is absorbed into the NOx absorbent, in the form of, for example, $SO_4^{2-}$, together with NOx. However, SOx absorbed in the NOx absorbent cannot be released therefrom merely by shifting the air-fuel ratio of exhaust gas flowing into the NOx absorbent to the fuel-richer side. Therefore, the amount of SOx in the NOx absorbent gradually increases and, as the amount of SOx absorbed in the NOx absorbent increases, the NOx absorbing capability of the absorbent decreases and, eventually, the NOx absorbent becomes substantially unable to absorb NOx. However, SOx absorbed in the NOx absorbent may be released in the form of, for example, $SO_2$, by decreasing the oxygen concentration in exhaust gas flowing into the NOx absorbent when the temperature of the NOx absorbent is relatively high. Thus, a known emission control apparatus causes a NOx absorbent to release SOx by temporarily shifting the air-fuel ratio of exhaust gas flowing into the NOx absorbent to the theoretical air-fuel ratio or to the richer side thereof while heating the NOx absorbent.

If exhaust gas flowing into the NOx absorbent contains a large amount of oxygen and a large amount HC at the same time, the oxygen and the HC react on the NOx absorbent, so that reaction heat is produced and the NOx absorbent is heated. A related-art emission control apparatus utilizing this phenomenon is described in, for example, Japanese Patent Application Laid-Open No. HEI 8-61052. In this apparatus, a plurality of engine cylinders are divided into a first cylinder group and a second cylinder group. The emission control apparatus causes SOx absorbed in a NOx absorbent to be released therefrom by setting the air-fuel ratio of the mixture to be burned in the first cylinder group to the richer side to produce exhaust gas containing a large amount of HC, and setting the air-fuel ratio of the mixture to be burned in the second cylinder group to the leaner side to produce exhaust gas containing a large amount of oxygen. The exhuast gas from both the first and second cylinder groups is then simultaneously introduced into the NOx absorbent to heat the NOx absorbent, and the average air-fuel ratio of the influent exhaust gas is set to the theoretical air-fuel ratio or to the richer side thereof so that SOx is released from the NOx absorbent.

In order to efficiently utilize oxygen and HC flowing into the NOx absorbent to heat the NOx absorbent, it is necessary to keep the influent exhaust gas average air-fuel ratio at the theoretical air-fuel ratio or slightly to the richer side thereof. Therefore, in the aforementioned emission control apparatus, an air-fuel ratio sensor for detecting the influent exhaust gas average air-fuel ratio is provided in a portion of the exhaust passage upstream of the NOx absorbent. Based on an output signal of the air-fuel ratio sensor, the apparatus controls the amounts of fuel injected into the first and second groups of cylinders so that the influent exhaust gas average air-fuel ratio becomes equal to a target value, for example, the theoretical air-fuel ratio.

In the aforementioned emission control apparatus, however, since the air-fuel ratio sensor is disposed upstream of the NOx absorbent in the exhaust passage, a large amount of HC comes into contact with the air-fuel ratio sensor, and therefore produces a large amount of hydrogen ($H_2$). Therefore, there is a danger that the air-fuel ratio sensor will covered with a large amount of $H_2$. If the air-fuel ratio sensor is covered with $H_2$, the contact of the air-fuel ratio sensor with oxygen carried in the exhaust gas becomes less likely, so that the air-fuel ratio sensor may falsely detect that the influent exhaust gas average air-fuel ratio is on the richer side. Based on this false detection, the amounts of fuel to be injected into the first and second groups of cylinders will be controlled so that the influent exhaust gas average air-fuel ratio is shifted to the leaner side although this operation is actually not needed. Thus, the related-art emission control apparatus has a problem of false control of the influent exhaust gas average air-fuel ratio.

SUMMARY OF THE INVENTION

Accordingly, it is an object of the invention to provide air-fuel ratio control of an internal combustion engine capable of heating an emission control catalyst while keeping an influent exhaust gas average air-fuel ratio regarding the catalyst at its target value.

To achieve the aforementioned and other objects of the invention, one aspect of the invention provides an air-fuel ratio control apparatus of an internal combustion engine in which a plurality of cylinders are divided into a first cylinder group and a second cylinder group that are connected to a common confluent exhaust passage, and in which an emission control catalyst device is disposed in the confluent exhaust passage. The air-fuel ratio control apparatus includes first means for setting an influent target value of an average influent air-fuel ratio of exhaust gas flowing into the emission control catalyst device, second means for setting a first group target value of a first group air-fuel ratio of exhaust gas from the first cylinder group to a value richer than the influent target value, and setting a second group target value of a second group air-fuel ratio of exhaust gas from the second cylinder group to a value leaner than the influent target value, and the second means setting the first group target value and the second group target value so that, when the first group air-fuel ratio and the second group air-fuel ratio are equal to the first group target value and the second group target value, respectivly, the average influent air-fuel ratio becomes equal to the influent target value, third means for calculating a first amount of fuel to be injected to cylinders of the first cylinder group and a second amount of fuel to be injected to the cylinders of the second cylinder group so that the first group air-fuel ratio and the second group air-fuel ratio become equal to the first group target value and the second group target value, respectively, an air-fuel ratio sensor disposed in a portion of the confluent exhaust passage extending downstream of the emission control catalyst device and fourth means for correcting, based on an air-fuel ratio detected by the air-fuel ratio sensor, the first amount of fuel and the second amount of fuel so that the average influent air-fuel ratio becomes equal to the influent target value.

In the above-described air-fuel ratio control apparatus, since the air-fuel ratio sensor is disposed in the portion of the exhaust passage downstream of the emission control catalyst device, the air-fuel ratio sensor is prevented from contacting large amounts of HC. Thus, the control apparatus prevents false correction of the influent exhaust gas average air-fuel ratio, and therefore is able to control the influent exhaust gas average air-fuel ratio to its target value.

Furthermore, to achieve the aforementioned and other objects of the invention, another aspect of the invention provides an air-fuel ratio control method of an internal combustion engine in which a plurality of cylinders are divided into a first cylinder group and a second cylinder group that are connected to a common confluent exhaust passage, and an emission control catalyst device is disposed in the confluent exhaust passage. In the control method, an influent target value of an average influent air-fuel ratio exhaust gas flowing into the emission control catalyst device is set. A first group target value of a first group air-fuel ratio of exhaust gas from the first cylinder group is set to a value richer than the influent target value, and a second group target value of a second group air-fuel ratio of exhaust gas from the second cylinder group is set to a value leaner than the influent target value, and setting the first group and second group target so that when the first group and second group air-fuel ratios are equal to the first group and second group target values, respectivly, the average influent air-fuel ratio becomes equal to the influent target value. A first group amount of fuel to be injected to the first cylinder group and a second group amount of fuel to be injected to the second cylinder group are calculated such that the first group air-fuel ratio and the second group air-fuel ratio become equal to the first group and second group target values, respectively. The first group and second group amounts of fuel are corrected so that the average influent air-fuel ratio becomes equal to the influent target value, based on an air-fuel ratio detected by an air-fuel ratio sensor disposed in a portion of the confluent exhaust passage downstream of the emission control catalyst device.

In the above-described air-fuel ratio control method, since the air-fuel ratio sensor 30 is disposed in the portion of the exhaust passage downstream of the emission control catalyst device, the air-fuel ratio sensor is prevented from contacting large amounts of HC. Thus, the control method prevents false correction of the influent exhaust gas average air-fuel ratio, and therefore is able to control the influent exhaust gas average air-fuel ratio to its target value.

The above-described emission control catalyst device is designed to lessen a harmful gas component of exhaust gas by catalysis.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
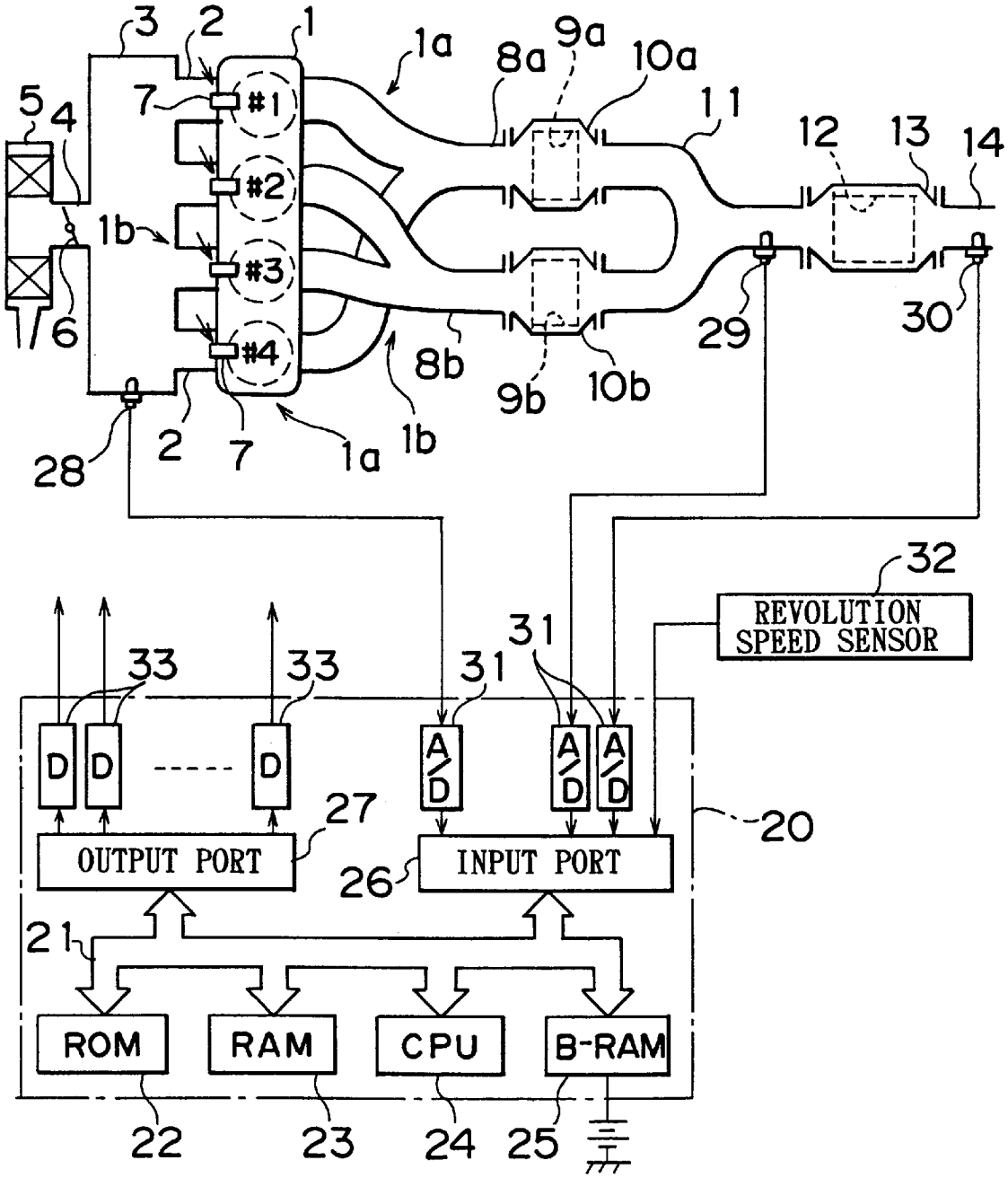
FIG. 1 illustration of an overall construction of an internal combustion engine.

Preferred embodiments of the invention will be described in detail with reference to the accompanying drawings. Referring first to FIG. 1, an internal combustion engine body 1 has a plurality of cylinders, for example, four cylinders. The cylinders are connected to a surge tank 3 via corresponding intake branch pipes 2. The surge tank 3 is connected to an air cleaner 5 via an intake duct 4. A throttle valve 6 is disposed in the intake duct 4. Each cylinder is provided with a fuel injection valve 7 for injecting fuel directly into the cylinder. The cylinders of the engine body 1 are divided into a first cylinder group 1*a* of No. 1 cylinder #1 and No. 4 cylinder #4, and a second cylinder group 1*b* of No. 2 cylinder #2 and No. 3 cylinder #3. The exhaust stroke sequence of the engine body 1 is #1-#3-#4-#2. That is, the cylinders of the engine body 1 are divided into the two groups in such a manner that the exhaust stroke of each cylinder of the first cylinder group does not overlap the exhaust stroke of any cylinder of the second cylinder group. The cylinders of the first cylinder group 1*a* are connected to a casing 10*a* that accommodates a startup catalyst device 9*a*, via an exhaust manifold 8*a*. The cylinders of the second cylinder group 1*b* are connected to a casing 10*b* accommodating a startup catalyst device 9*b*, via an exhaust manifold 8*b*. The casings 10*a*, 10*b* are connected to a casing 13 accommodating a NOx absorbent 12, via a common confluent exhaust pipe 11. The casing 13 is connected to an exhaust pipe 14.

An electronic control unit 20 is formed by a digital computer that has a ROM (read-only memory) 22, a RAM (random access memory) 23, a CPU (microprocessor) 24, a B-RAM (backup RAM) 25 that is constantly supplied with power, an input port 26, and an output port 27. These components of the electronic control unit 20 are interconnected by a bidirectional bus 21. The surge tank 3 is provided with a pressure sensor 28 that generates an output voltage proportional to the absolute pressure in the surge tank 3. A confluent portion of the confluent exhaust pipe 11 is provided with a temperature sensor 29 that generates an output voltage proportional to the temperature of exhaust gas flowing into the NOx absorbent 12. A portion of the exhaust pipe 14 that extends downstream of the NOx absorbent 12 is provided with an air-fuel ratio sensor 30 that generates an output voltage that indicates the air-fuel ratio of exhaust gas discharged from the NOx absorbent 12. The exhaust gas temperature detected by the temperature sensor 29 represents the temperature TNA of the NOx absorbent 12. The output voltages of the sensors 28, 29, 30 are inputted to the input port 26 via corresponding AID converters 31. The CPU 24 calculates an intake air flow Q based on the output voltage from the pressure sensor 28. The input port 26 is also connected to a revolution speed sensor 32 that generates output pulses indicating the engine revolution speed N. The output port 27 is connected to the fuel injection valves 7 and ignition plugs (not shown) via corresponding drive circuits 33. Therefore, the fuel injection valves 7 and the ignition plugs are controlled based on output signals from the electronic control unit 20.

Figure 2:
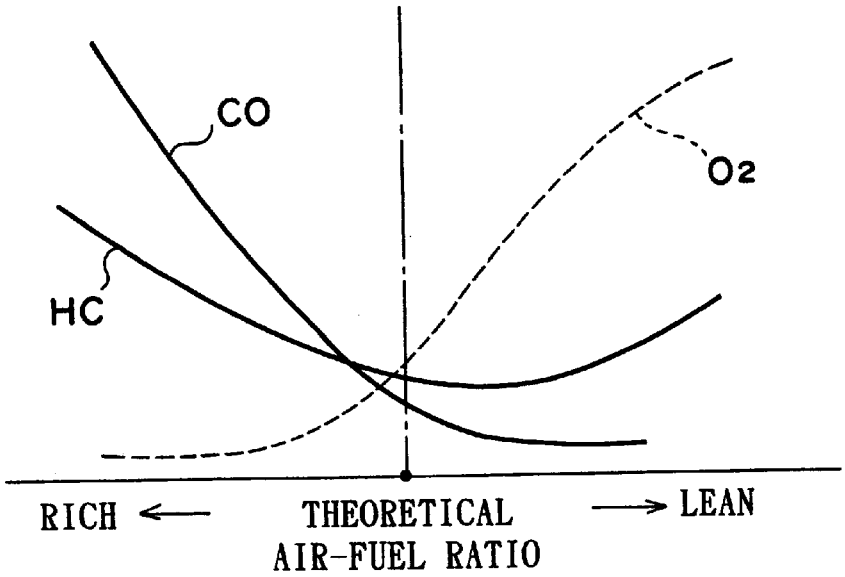
FIG. 2 is a schematic graph indicating the concentrations of unburned HC, unburned CO and oxygen in exhaust gas discharged from the internal combustion engine.

FIG. 2 is a schematic diagram indicating the concentrations of representative components contained in exhaust gas discharged from the cylinders. As indicated in FIG. 2, the amounts of unburned HC and CO contained in exhaust gas from the cylinders increase as the air-fuel ratio of mixture to be burned in the cylinders shifts to a richer side. The amount of oxygen $O_2$ contained in exhaust gas from the cylinders increases as the air-fuel ratio of mixture to be burned in the cylinders shifts to a leaner side.

The startup catalyst devices 9*a*, 9*b* are provided for cleaning exhaust gas during an early period following the engine startup, during which the NOx absorbent 12 is not activated. The startup catalyst devices 9*a*, 9*b* are each formed by, for example, a three-way catalyst device that is formed by loading an alumina support with a precious metal such as platinum Pt or the like.

The NOx absorbent 12 is formed by, for example, loading an alumina support with a precious metal, such as platinum Pt, palladium Pd, rhodium Rh, iridium Ir, etc., and at least one element selected from the group of alkali metals, such as potassium K, sodium Na, lithium Li, cesium Cs, etc., alkaline earths, such as barium Ba, calcium Ca, etc., and rare earths, such as lanthanum La, yttrium Y, etc. The NOx absorbent 12 absorbs and releases NOx in the following manner. That is, the NOx absorbent 12 absorbs NOx when the average air-fuel ratio of exhaust gas flowing into the NOx absorbent 12, that is, the influent exhaust gas average air-fuel ratio, is on the leaner side. The NOx absorbent 12 releases absorbed NOx when the oxygen concentration in the influent exhaust gas decreases to or below a certain level. If air or fuel is not supplied into a portion of the exhaust passage upstream of the NOx absorbent 12, the influent exhaust gas average air-fuel ratio becomes equal to the ratio of the total amount of air to the total amount of fuel supplied to the cylinders.

Figure 3A:
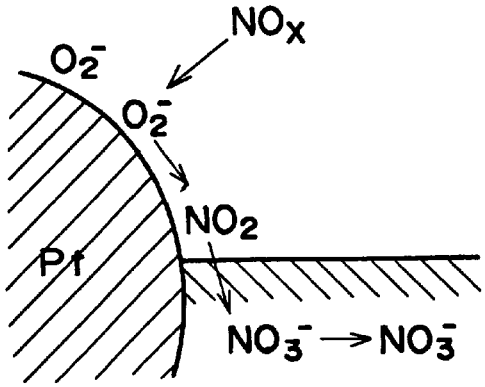
FIGS. 3A and 3B illustrate the NOx absorption and release of a NOx absorbent.
Figure 3B:
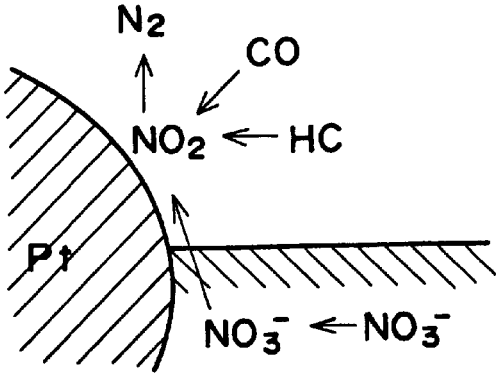

Although the NOx absorbent 12, disposed in the exhaust passage of the engine, actually absorbs and releases NOx, the detailed mechanism of the absorption and release of NOx by the NOx absorbent is not completely elucidated. However, the absorption and release of NOx is considered to occur by a mechanism as illustrated in FIGS. 3A and 3B. Although the mechanism will be described below with reference to a NOx absorbent formed by loading a support with platinum Pt and barium Ba, substantially the same mechanism applies to NOx absorbents formed by using precious metals other than platinum, and alkali metals, alkaline earths or rare earths other than barium.

When the influent exhaust gas average air-fuel ratio considerably shifts from the theoretical air-fuel ratio to the leaner side, the oxygen concentration in exhaust gas flowing into the catalyst device considerably increases, so that oxygen $O_2$ deposits on surfaces of platinum Pt in the form of $O_{2^-}$ or $O^{2-}$, as illustrated in FIG. 3A. Nitrogen monoxide NO contained in influent exhaust gas reacts with $O_{2^-}$ or $O^{2-}$ on the surfaces of platinum Pt to produce $NO_2$ ($2NO+O_2 \rightarrow 2NO_2$). Part of the thus-produced $NO_2$ is absorbed into the absorbent while being oxidized on platinum Pt, and binds with barium oxide BaO, and then diffuses in the form of nitrate ions $NO_{3^-}$ into the absorbent as illustrated in FIG. 3A. In this manner, NOx is absorbed into the NOx absorbent 12.

As long as the oxygen concentration in influent exhaust gas remains high, $NO_2$ is produced on the surfaces of platinum Pt. $NO_2$ is absorbed into the absorbent and produces $NO_{3^-}$ as long as the NOx absorbing capacity of the absorbent is not saturated. However, if the oxygen concentration in influent exhaust gas decreases, the production of $NO_2$ also decreases, so that the reaction reverses in direction ($NO_{3^-} \rightarrow NO_2$) and, as a result, nitrate ions $NO_{3^-}$ are released from the absorbent in the form of $NO_2$. That is, if the oxygen concentration in influent exhaust gas decreases, the NOx absorbent 12 releases NOx. The oxygen concentration in influent exhaust gas decreases as the degree of leanness of influent exhaust gas decreases. Therefore, if the degree of leanness of influent exhaust gas is reduced, the NOx absorbent 12 releases NOx.

If the influent exhaust gas average air-fuel ratio is shifted toward a richer side, and particularly if the influent exhaust gas average air-fuel ratio is shifted to the richer side of the theoretical air-fuel ratio, HC and CO, contained in large amounts in exhaust gas in that condition as indicated in FIG. 2, oxidize by reacting with oxygen $O_{2^-}$ or $O^{2-}$ on platinum Pt. If the influent exhaust gas average air-fuel ratio is shifted toward a richer side, and particularly if it is shifted to the richer side of the theoretical air-fuel ratio, the oxygen concentration in influent exhaust gas becomes extremely low, so that the absorbent releases $NO_2$, and $NO_2$ reduces by reacting with HC or CO as illustrated in FIG. 3B. When $NO_2$ disappears from the surfaces of platinum Pt as described above, $NO_2$ is released from the absorbent successively. Therefore, by shifting the influent exhaust gas average air-fuel ratio to the richer side of the theoretical air-fuel ratio, the NOx absorbent 12 releases NOx in a short time. Even if the influent exhaust gas average air-fuel ratio is on the leaner side of the theoretical air-fuel ratio, NOx can be released from the NOx absorbent 12 and can be reduced.

In this embodiment, the fuel injection duration TAU1 for each cylinder of the first cylinder group 1*a* and the fuel injection duration TAU2 for each cylinder of the second cylinder group 1*b* are calculated as in the following equations:

$$TAU1=TAUC\times(1+KC)$$

$$TAU2=TAUC\times(1-KC)$$

where TAUC is a corrected fuel injection duration, and KC is a change coefficient.

The corrected fuel injection duration TAUC is calculated as in the following equation:

$$TAU=(TB\times KT)\times(1+FAF+KK)$$

where TB is a basic fuel injection duration, KT is a target air-fuel ratio coefficient, FAF is a feedback correction coefficient, and KK is a correction coefficient.

The basic fuel injection duration TB is a fuel injection duration that is needed to change the proportion of the total amount of air to the total amount of fuel supplied to the engine to the theoretical air-fuel ratio. The basic fuel injection duration TB is predetermined through experiments. The basic fuel injection duration TB is pre-stored in the ROM 22, as a function of engine operation conditions, for example, the engine revolution speed N, and the absolute pressure PM in the surge tank 3 indicating the engine load, in the form of a map indicated in FIG. 4.

The target air-fuel ratio coefficient KT is a coefficient that is determined in accordance with the target value of the influent exhaust gas average air-fuel ratio regarding the NOx absorbent 12. The target air-fuel ratio coefficient KT is set as follows. If the target value of the influent exhaust gas average air-fuel ratio equals the theoretical air-fuel ratio, KT=1.0. If the target value is on the richer side of the theoretical air-fuel ratio, KT>1.0. If the target value is on the leaner side, KT<1.0. Thus, the multiplication product TB×KT represents a fuel injection duration that is needed to change the proportion of the total amount of air to the total amount of fuel supplied to the engine to the target value of the influent exhaust gas average air-fuel ratio.

The feedback correction coefficient FAF is a coefficient for keeping the influent exhaust gas average air-fuel ratio at the target value on the basis of the output signal of the air-fuel ratio sensor 30 when the target value of the influent exhaust gas average air-fuel ratio equals the theoretical air-fuel ratio or a ratio that is slightly to the richer side of the theoretical air-fuel ratio. When the target value of the influent exhaust gas average air-fuel ratio is on the leaner or richer side, the feedback correction coefficient FAF is fixed to zero.

The correction coefficient KK is a combined coefficient of an engine warm-up-occasion increasing correction coefficient, an acceleration-occasion increasing correction coefficient, a learned correction coefficient, and the like. The correction coefficient KK is set to zero when such correction is not needed.

Figure 5:
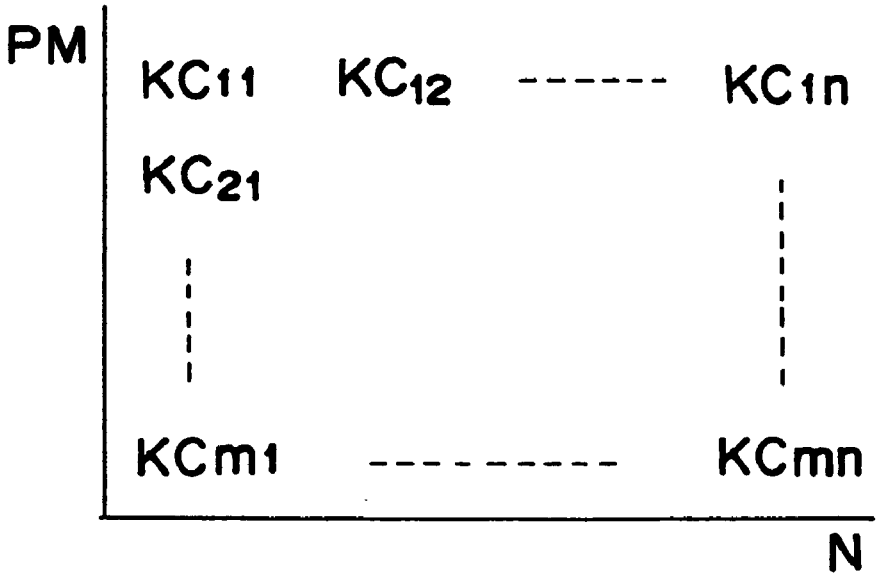
FIG. 5 is a diagram indicating a map of a change coefficient KC.

The change coefficient KC is a coefficient for varying the air-fuel ratio of mixture to be burned in the first cylinder group 1*a* and the air-fuel ratio of mixture to be burned in the second cylinder group 1*b* from each other. In particular, the coefficient sets the air-fuel ratio of mixture to be burned in the first cylinder group 1*a* to a richer side of the target value of the influent exhaust gas average air-fuel ratio, and sets the air-fuel ratio of mixture to be burned in the second cylinder group 1*b* to the leaner side of the target value of the influent exhaust gas average air-fuel ratio. The change coefficient KC is fixed to zero when the air-fuel ratios of mixture to be burned in all the cylinders need to be equal. The change coefficient KC is predetermined so that the NOx absorbent temperature TNA is kept higher than the SOx release temperature described below. The change coefficient KC is pre-stored in the ROM 22, for example, as a function of the absolute pressure PM in the surge tank 3 and the engine revolution speed N, in the form of a map as indicated in FIG. 5.

In this embodiment, when a lean condition is met, the air-fuel ratio of mixture to be burned in each cylinder group 1*a*, 1*b* is set to the leaner side of the theoretical air-fuel ratio. When the lean condition is not met, the air-fuel ratio of mixture to be burned in the two cylinder groups 1*a*, 1*b* is set to the theoretical air-fuel ratio. It is determined that the lean condition is not met, for example, when the engine load is higher than a predetermined load, or when the engine warm-up operation is being performed, or when the NOx absorbent 12 is not activated. In the other circumstances, it is determined that the lean condition is met. Therefore, when the lean condition is met, the target value of the influent exhaust gas average air-fuel ratio is set to a fuel-lean air-fuel ratio, and when the lean condition is not met, the target value of the influent exhaust gas average air-fuel ratio is set to the theoretical air-fuel ratio. Hence, when the lean condition is met, the target air-fuel ratio coefficient KT is set to a value KL (e.g., 0.6) that is less than 1.0, and the feedback correction coefficient FAF and the change coefficient KC are fixed to zero. When the lean condition is not met, the target air-fuel ratio coefficient KT is fixed to 1.0, and the feedback correction coefficient FAF is calculated based on the output signal of the air-fuel ratio sensor 30, and the change coefficient KC is fixed to zero.

When the lean condition is met, NOx in exhaust gas discharged from the engine is absorbed into the NOx absorbent 12. However, since the NOx absorbing capacity of the NOx absorbent 12 is limited, there is a need to release NOx from the NOx absorbent 12 before the NOx absorbing capacity of the NOx absorbent 12 is saturated. In the embodiment, therefore, when the amount of NOx absorbed in the NOx absorbent 12 becomes greater than a predetermined amount, the air-fuel ratio of mixture to be burned in each cylinder group 1*a*, 1*b* is temporarily shifted to the richer side of the theoretical air-fuel ratio, in order to release NOx from the NOx absorbent 12 and reduce NOx. That is, when the amount of NOx absorbed in the NOx absorbent 12 becomes greater than the predetermined amount, the target value of the influent exhaust gas average air-fuel ratio is switched to the richer side. Therefore, when NOx absorbed in the NOx absorbent 12 needs to be released and reduced, the target air-fuel ratio coefficient KT is temporarily switched to a value KN (e.g., 1.3) that is greater than 1.0, and the feedback correction coefficient FAF and the change coefficient KC are fixed to zero.

However, fuel and lubricant used in the engine contain sulfuric substances, exhaust gas flowing into the NOx absorbent 12 contains sulfuric substances, for example, SOx. Therefore, besides NOx, SOx is also absorbed into the NOx absorbent 12. The mechanism of absorption of SOx into the NOx absorbent 12 is considered to be substantially the same as the NOx absorption mechanism.

As in the above explanation of the NOx absorption mechanism, the SOx absorption mechanism will be explained with reference to an absorbent formed by loading a support with platinum Pt and barium Ba. As mentioned above, when the influent exhaust gas average air-fuel ratio is on the leaner side of the theoretical air-fuel ratio, oxygen $O_2$ deposits on surfaces of platinum Pt in the form of $O_2^-$ or $O^{2-}$. Then, SOx contained in influent exhaust gas, for example $SO_2$, reacts with $O_2^-$ or $O^{2-}$ on the surfaces of platinum Pt to produce $SO_3$. The thus-produced $SO_3$ is absorbed into the absorbent while being oxidized on platinum Pt, and binds with barium oxide BaO, and then diffuses in the form of sulfate ions $SO_4^{2-}$ into the absorbent. Then, the sulfate ions $SO_4^{2-}$ bind with barium ions $Ba^{2+}$ to produce a sulfate $BaSO_4$.

The sulfate $BaSO_4$ does not readily decompose. In fact, the sulfate $BaSO_4$ does not decompose but remains intact even if the influent exhaust gas average air-fuel ratio is simply shifted to the richer side of the theoretical air-fuel ratio. Therefore, as time elapses, the amount of the sulfate $BaSO_4$ in the NOx absorbent 12 increases, so that the amount of NOx that can be absorbed into the NOx absorbent 12 decreases with elapse of time.

However, if the influent exhaust gas average air-fuel ratio is set to the theoretical air-fuel ratio or to the richer side thereof when the temperature of the NOx absorbent 12 is higher than the SOx release temperature, the sulfate $BaSO_4$, produced in the NOx absorbent 12, is decomposed and sulfate ions $SO_4^{2-}$ are released from the NOx absorbent 12 in the form of $SO_3$. In the embodiment, therefore, when the amount of SOx absorbed in the NOx absorbent 12 becomes greater than a predetermined amount, the influent exhaust gas average air-fuel ratio is temporarily set to a slightly rich air-fuel ratio (e.g., about 13.5–14.0) while the NOx absorbent 12 is being heated. SOx is thereby released from the NOx absorbent 12. The released $SO_3$ is immediately reduced into $SO_2$ by HC and CO contained in influent exhaust gas.

As stated above, if exhaust gas flowing into the NOx absorbent 12 contains a large amount of oxygen and a large amount of HC simultaneously, oxygen and HC react on the NOx absorbent 12 to produce reaction heat, so that the NOx absorbent 12 is heated. Furthermore, if the influent exhaust gas average air-fuel ratio is slightly to the richer side of the theoretical air-fuel ratio, HC can be efficiently utilized on the NOx absorbent 12 to heat the NOx absorbent 12. As indicated in FIG. 2, exhaust gas contains a large amount of HC when the air-fuel ratio of mixture to be burned in the cylinders is on the richer side, and exhaust gas contains a large amount of oxygen when the air-fuel ratio of mixture to be burned in the cylinders is on the leaner side. In the embodiment, therefore, when NOx absorbent 12 needs to release SOx, the air-fuel ratio of mixture to be burned in the first cylinder group 1*a* is set to a rich air-fuel ratio to produce exhaust gas containing a large amount of HC, and the air-fuel ratio of mixture to be burned in the second cylinder group 1*b* is set to a lean air-fuel ratio to produce exhaust gas containing a large amount of oxygen. At the same time, the influent exhaust gas average air-fuel ratio is shifted slightly to a richer side. That is, the target value of the influent exhaust gas average air-fuel ratio is temporarily switched to a slightly fuel-rich value. Therefore, when the NOx absorbent 12 needs to release SOx, the target air-fuel ratio coefficient KT is temporarily switched to a value KS (e.g., 1.1.) that is greater than 1.0, an the feedback correction coefficient FAF is calculated based on the output signal of the air-fuel ratio sensor 30, and the change coefficient KC is fixed to zero.

In short, when the NOx absorbent 12 needs to release SOx, the target value of the influent exhaust gas average air-fuel ratio is slightly shifted to the richer side, and the target value of the air-fuel ratio of exhaust gas from the first cylinder group 1*a* is set to a value that is on the richer side of the target value of the influent exhaust gas average air-fuel ratio, and the target value of the air-fuel ratio of exhaust gas from the second cylinder group 1*b* is set to a value that is on the leaner side of the target value of the influent exhaust gas average air-fuel ratio, and the target values of the air-fuel ratio of exhaust gas from the first and second cylinder groups are set so that when the air-fuel ratios of exhaust gas from the first and second cylinder groups are equal to their respective target values, the influent exhaust gas average air-fuel ratio becomes equal to a slightly rich air-fuel ratio.

If the influent exhaust gas average air-fuel ratio is on the leaner side of its target value when the NOx absorbent 12 needs to release SOx, release of SOx from the NOx absorbent 12 is relatively impeded and, moreover, SOx released from the NOx absorbent 12 is likely to be absorbed into the NOx absorbent 12 again. If the influent exhaust gas average air-fuel ratio is excessively richer than the target value when the NOx absorbent 12 needs to release SOx, there is a danger of deterioration of the fuel economy or the overheating of the NOx absorbent 12. Therefore, it is desirable to keep the influent exhaust gas average air-fuel ratio at its target value when the NOx absorbent 12 needs to release SOx. In the embodiment, therefore, when the NOx absorbent 12 needs to release SOx, the influent exhaust gas average air-fuel ratio is feedback-controlled by using the feedback correction coefficient FAF so that the influent exhaust gas average air-fuel ratio becomes equal to its target value. However, when the lean condition is not met, the target value of the influent exhaust gas average air-fuel ratio is set to the theoretical air-fuel ratio. Since the NOx absorbent 12 is able to function as a three-way catalyst, it is desirable to keep the influent exhaust gas average air-fuel ratio at the theoretical air-fuel ratio in this situation for good emission control. Therefore, in the embodiment, the influent exhaust gas average air-fuel ratio is feedback-controlled by using the feedback correction coefficient FAF so that the influent exhaust gas average air-fuel ratio becomes equal to its target value, when the lean condition is not met, as well.

Figure 6:
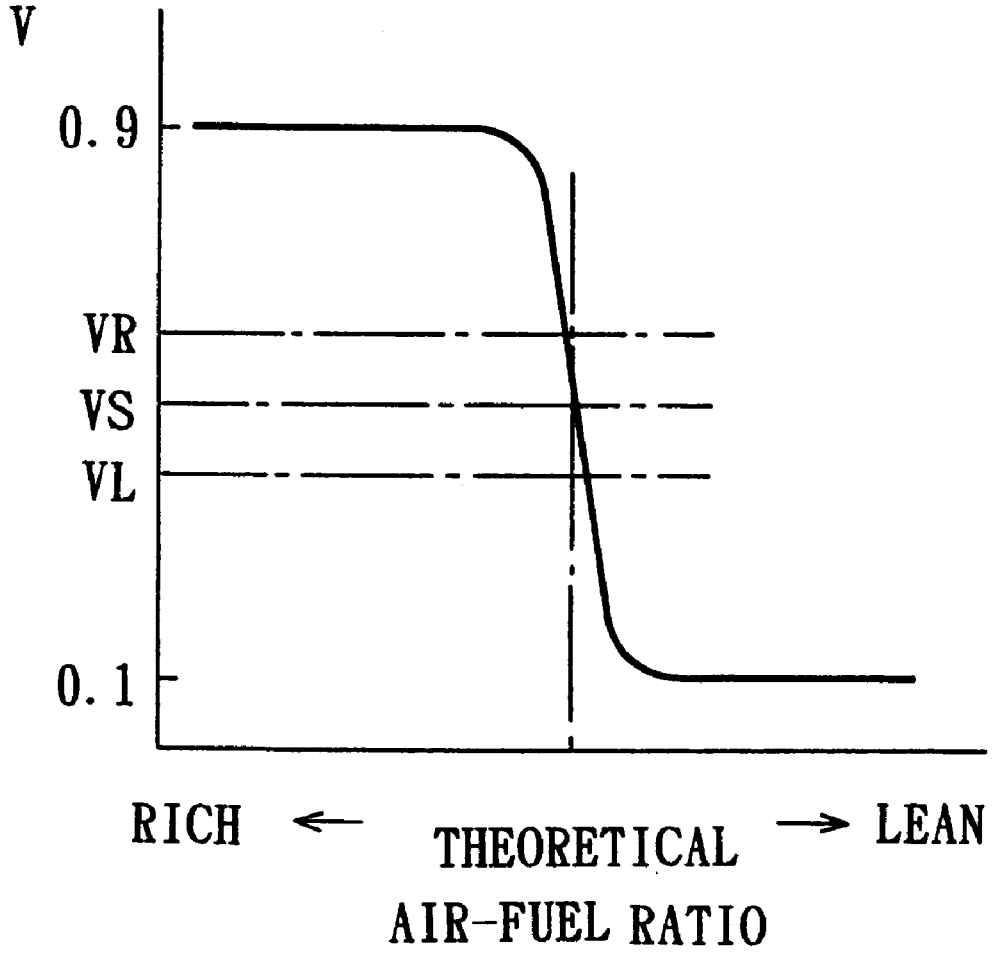
FIG. 6 is a diagram indicating a output voltage of a air-fuel ratio sensor

The feedback correction coefficient FAF is calculated based on the output signal of the air-fuel ratio sensor 30. Although any type of air-fuel ratio sensor may be used as the air-fuel ratio sensor 30, this embodiment uses an air-fuel ratio sensor whose output voltage varies in accordance with the oxygen concentration in exhaust gas. As indicated in FIG. 6, the output voltage V of the air-fuel ratio sensor 30 becomes equal to a reference voltage VS (e.g., 0.45 V) when the air-fuel ratio equals the theoretical air-fuel ratio. When the air-fuel ratio considerably shifts to the richer side of the theoretical air-fuel ratio, the output voltage V becomes constant at a value (e.g., about 0.9 V) that is greater than a richside reference voltage VR. When the air-fuel ratio considerably shifts to the leaner side, the output voltage V becomes constant at a value (e.g., about 0.1 V) that is less than a leanside reference voltage VL.

The method of calculating the feedback correction coefficient FAF when the lean condition is not met will be described. In this case, the feedback correction coefficient FAF is calculated by a second FAF calculating routine illustrated in FIG. 7.

Figure 7:
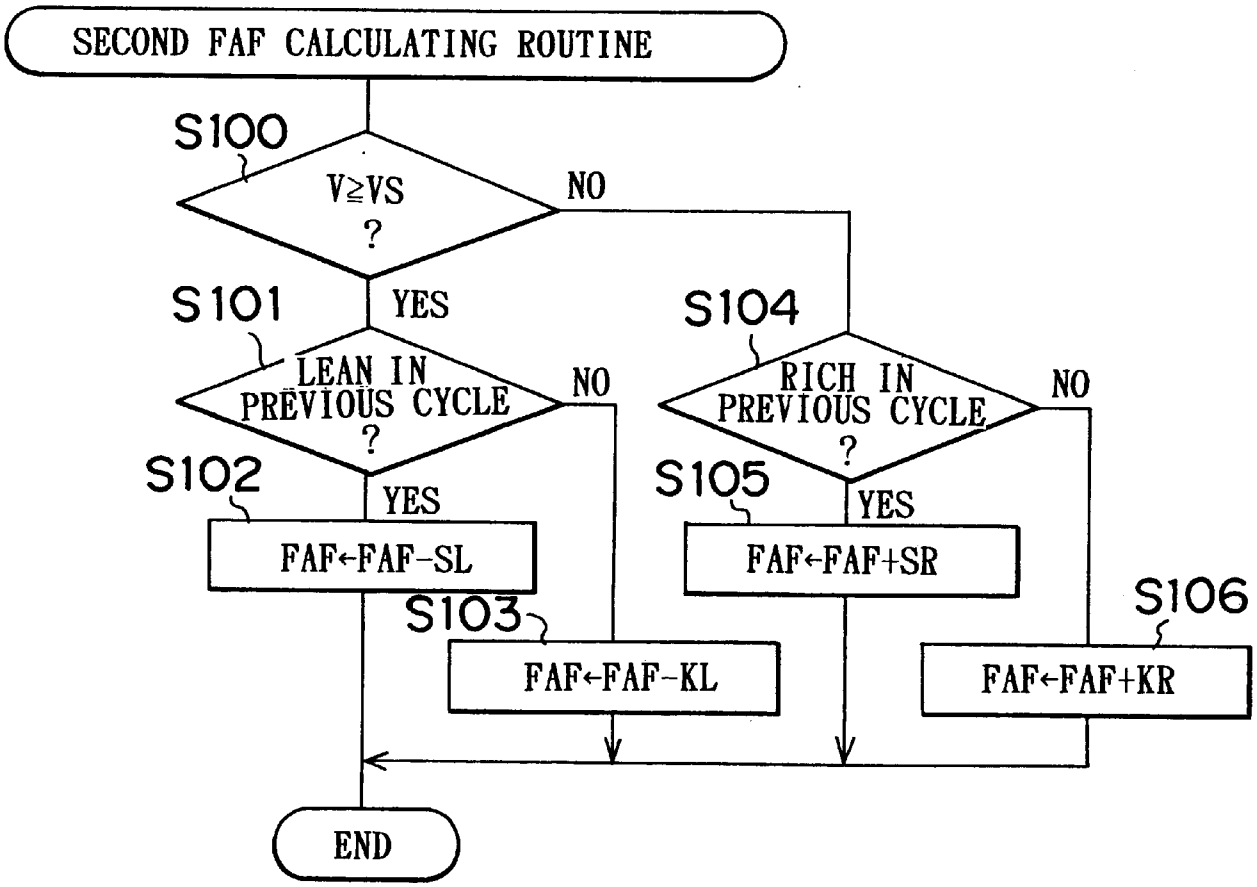
FIG. 7 is a flowchart illustrating a second FAF calculating routine.
Figure 8:
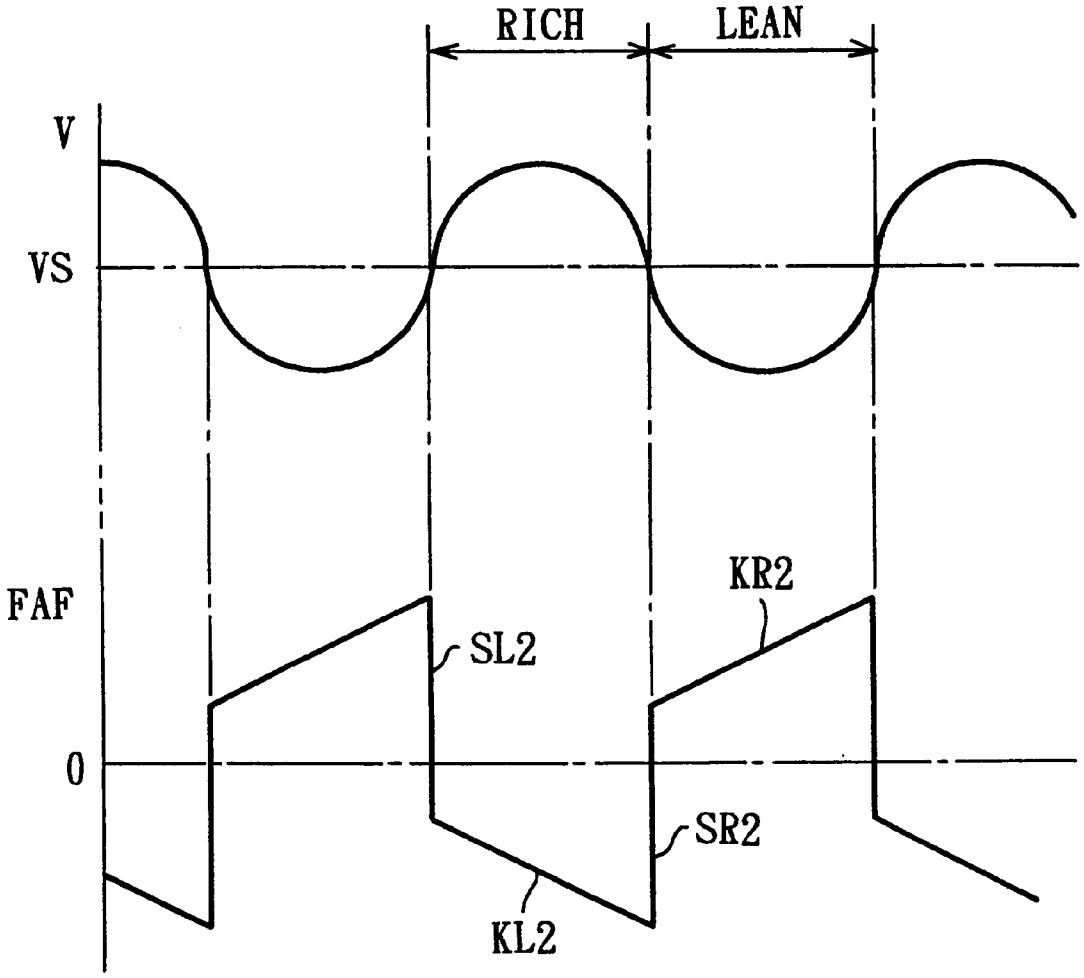
FIG. 8 is a graph indicating changes of a feedback correction coefficient FAF caused by the second FAF calculating routine.

Referring to FIG. 7, in step 100, it is determined whether the output voltage V of the air-fuel ratio sensor 30 is higher than the reference voltage VS, that is, whether the detected exhaust gas air-fuel ratio, that is, the air-fuel ratio of exhaust gas detected by the air-fuel ratio sensor 30, is on the richer side of the theoretical air-fuel ratio. If $V \geqq VS$, that is, if the detected exhaust gas air-fuel ratio is on the richer side, the process proceeds to step 101, in which it is determined whether the air-fuel ratio in the previous cycle of the routine is on the leaner side of the theoretical air-fuel ratio. If the air-fuel ratio in the previous cycle is on the leaner side, that is, if the air-fuel ratio has changed from the leaner side to the richer side, the process proceeds to step 102. In step 102, a skip value SL2 is subtracted from the feedback correction coefficient FAF, that is, the feedback correction coefficient FAF is sharply reduced by the skip value SL2 as indicated in FIG. 8. Conversely, if it is determined in step 101 that the air-fuel ratio in the previous cycle is on the richer side of the theoretical air-fuel ratio, the process proceeds to step 103. In step 103, an integral KL2 (<<SL2) is subtracted from the feedback correction coefficient FAF, so that the feedback correction coefficient FAF is gradually reduced as indicated in FIG. 8.

If V<VS in step 100, the process proceeds to step 104, in which it is determined whether the air-fuel ratio in the previous cycle of the routine is on the richer side of the theoretical air-fuel ratio. If the air-fuel ratio in the previous cycle is on the richer side, that is, if the air-fuel ratio has changed from the richer side to the leaner side, the process proceeds to step 105. In step 105, a skip value SR2 is added to the feedback correction coefficient FAF, that is, the feedback correction coefficient FAF is sharply increased by the skip value SR2 as indicated in FIG. 8. Conversely, if the air-fuel ratio in the previous cycle is on the leaner side of the theoretical air-fuel ratio, the process proceeds to step 106. In step 106, an integral KR2 (<<SR2) is added to the feedback correction coefficient FAF, so that the feedback correction coefficient FAF is gradually increased as indicated in FIG. 8.

Figure 9:
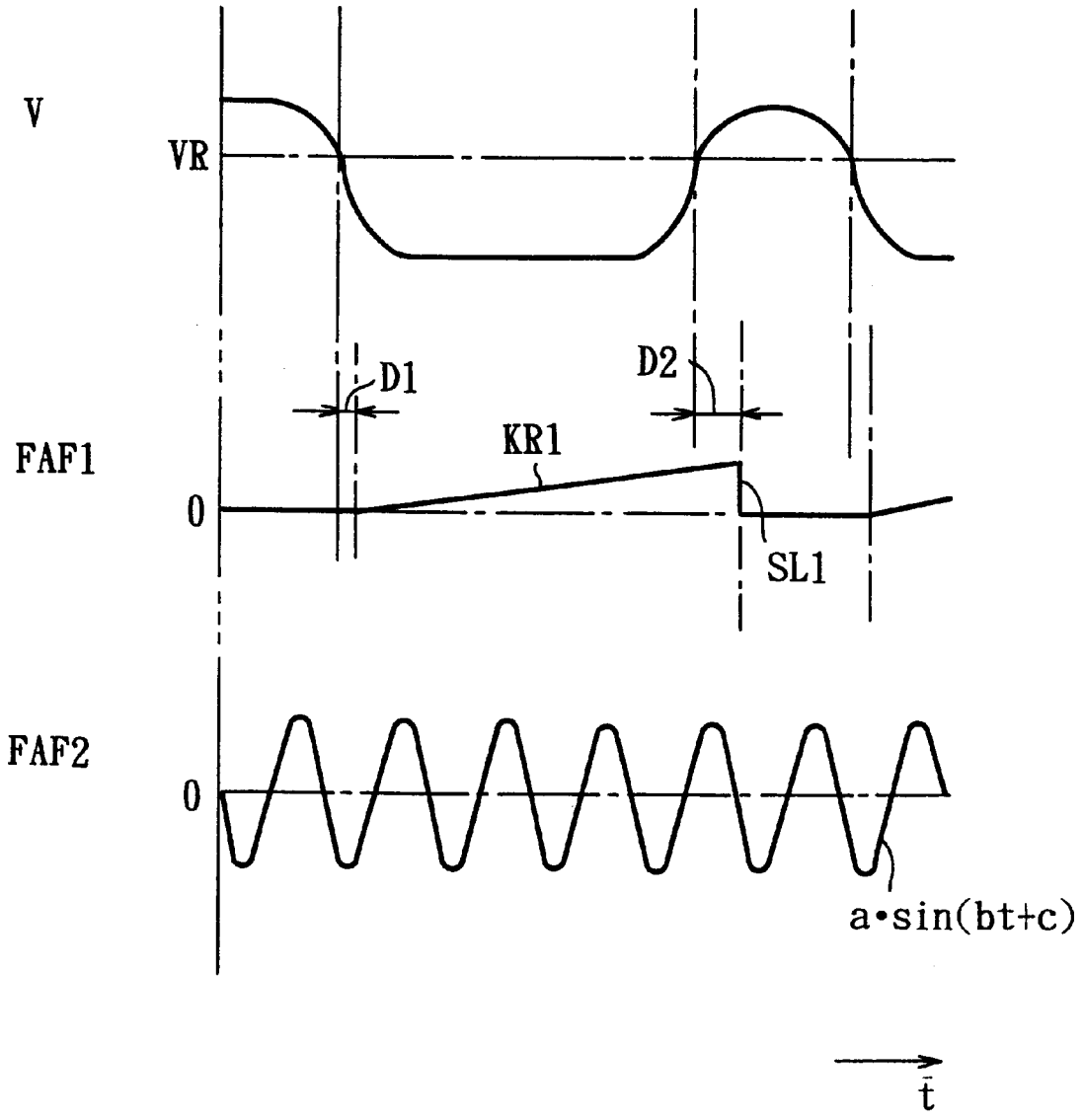
FIG. 9 is a graph indicating changes of first and second correction coefficients FAF1, FAF2 caused by the second FAF calculating routine.

The method of calculating the feedback correction coefficient FAF when the NOx absorbent 12 needs to release SOx will be described with reference to FIG. 9. In this case, the feedback correction coefficient FAF is calculated by adding a correction coefficient FAF1 that is calculated based on the output signal of the air-fuel ratio sensor 30 and a correction coefficient FAF2 that is calculated irrelevantly to the output signal of the air-fuel ratio sensor 30 (FAF=FAF1 +FAF2). The method of calculating the correction coefficient FAF1 will first be described.

It is considered that while the NOx absorbent 12 is releasing SOx, the air-fuel ratio of exhaust gas discharged from the NOx absorbent 12 remains substantially equal to the theoretical air-fuel ratio because oxygen remaining in the NOx absorbent 12 reacts with HC and CO contained in influent exhaust gas and because SOx released from the NOx absorbent 12 in the form of $SO_3$ is reduced by HC and CO in influent exhaust gas. Therefore, while SOx is being released, it is not clear whether the influent exhaust gas average air-fuel ratio is controlled to its target value even though the detected exhaust gas air-fuel ratio substantially equals the theoretical air-fuel ratio.

As mentioned above, it is not desirable that the influent exhaust gas average air-fuel ratio is on the leaner side when SOx needs to be released. In this embodiment, therefore, when the detected exhaust gas air-fuel ratio substantially equals the theoretical air-fuel ratio, that is, when the output voltage V of the air-fuel ratio sensor 30 is lower than the rich-side reference voltage VR, the correction coefficient FAF1 is gradually increased by using an integral KR1. That is, when the detected exhaust gas air-fuel ratio is on the leaner side of the exhaust gas air-fuel ratio represented by the rich-side reference voltage VR, which is termed reference air-fuel ratio, the correction coefficient FAF1 is gradually increased. Therefore, the influent exhaust gas average air-fuel ratio becomes unlikely to be on the leaner side of the theoretical air-fuel ratio.

However, it is undesirable that the correction coefficient FAF1 excessively increases and therefore the influent exhaust gas average air-fuel ratio becomes an excessively rich air-fuel ratio. If the influent exhaust gas average air-fuel ratio becomes an excessively rich air-fuel ratio, the detected exhaust gas air-fuel ratio also becomes a considerably rich air-fuel ratio, that is, the output voltage V becomes higher than the rich-side reference voltage VR. Therefore, in this embodiment, when the output voltage V is higher than the rich-side reference voltage VR, that is, when the detected exhaust gas air-fuel ratio is on the richer side of the reference air-fuel ratio, the correction coefficient FAF1 is fixed to zero.

In this case, the correction coefficient FAF1 may be set to a negative value, but the setting of the correction coefficient FAF1 to a negative can result in a sharp correction of the influent exhaust gas average air-fuel ratio to the leaner side. However, if FAF1=0 is set, it is considered that the influent exhaust gas average air-fuel ratio becomes substantially equal to the air-fuel ratio expressed by KS and that the detected exhaust gas air-fuel ratio gradually shifts to the leaner side. Therefore, the influent exhaust gas average air-fuel ratio becomes unlikely to be on the leaner side of the theoretical air-fuel ratio.

In short, when the detected exhaust gas air-fuel ratio is on the leaner side of the reference air-fuel ratio, the amounts of fuel injected into the first and second cylinder groups 1*a*, 1*b* are increased. When the detected exhaust gas air-fuel ratio is on the richer side of the reference air-fuel ratio, the increasing correction of the amounts of fuel injected in the first and second cylinder groups 1*a*, 1*b* is prevented. The absolute value of the feedback gain is set smaller in this case than when the target value of the influent exhaust gas average air-fuel ratio is equal to the theoretical air-fuel ratio. That is, the integral KF1 corresponding to the integral KR2 in FIG. 8 is smaller than the integral KR2, and the integral corresponding to the integral KL2 is zero, and the skip value corresponding to the skip value SR2 is zero, and the skip value SL1 corresponding to the skip value SL2 is smaller than the skip value SL2. In this manner, the correction speed of the amounts of fuel injected into the first and second cylinder groups 1*a*, 1*b* becomes smaller, so that the influent exhaust gas average air-fuel ratio becomes unlikely to be on the leaner side, and is prevented from becoming an excessively rich air-fuel ratio.

The output voltage V of the air-fuel ratio sensor 30 contains noises. Therefore, it is not desirable to switch the correction coefficient FAF1 to zero immediately after the detected exhaust gas air-fuel ratio switches, for example, from the richer side to the leaner side of the reference air-fuel ratio. In this embodiment, therefore, the operation of increasing the correction coefficient FAF1 is started after the elapse of a predetermined first set time D1 following the switch of the detected exhaust gas air-fuel ratio from the richer side to the leaner side of the reference air-fuel ratio. Furthermore, the correction coefficient FAF1 is fixed to zero after the elapse of a predetermined second set time D2 following the switch of the detected exhaust gas air-fuel ratio from the leaner side to the richer side of the reference air-fuel ratio. The second set time D2 is longer than the first set time D1 because the changing rate of the output voltage V of the air-fuel ratio sensor 30 is smaller in changes toward the leaner side than in changes toward the richer side. As a result, precise correction can be achieved.

The correction coefficient FAF2 is calculated as in, for example, the following equation:

$$FAF2=a\cdot\sin(b\times t+c)$$

where t is time, and a, b, c are coefficients. Thus, the correction coefficient FAF2 oscillates with respect to time, so that the feedback correction coefficient FAF is caused to oscillate with respect to time. This makes it possible to prevent considerable deviations of the influent exhaust gas average air-fuel ratio from its target value.

Figure 10:
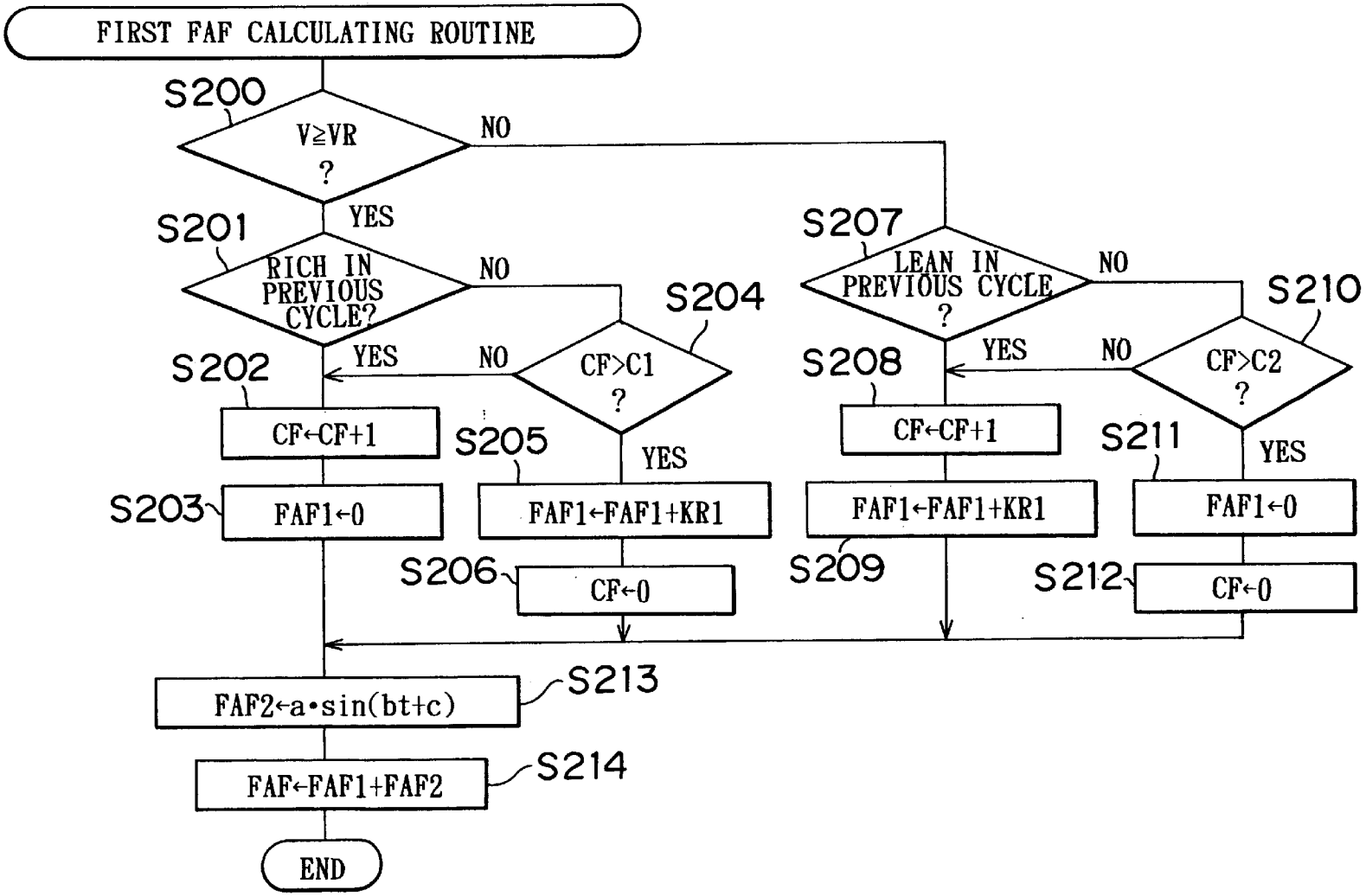
FIG. 10 is a flowchart illustrating a first FAF calculating routine.

FIG. 10 illustrates a first FAF calculating routine for calculating the feedback correction coefficient FAF when SOx needs to be released from the NOx absorbent 12. Referring to FIG. 10, in step 200, it is determined whether the output voltage V of the air-fuel ratio sensor 30 is lower than the rich-side reference voltage VR, that is, whether the detected exhaust gas air-fuel ratio is on the leaner side of the reference air-fuel ratio. If V≦VR, that is, if the detected exhaust gas air-fuel ratio is leaner than the reference air-fuel ratio, the process proceeds to step 201, in which it is determined whether the detected exhaust gas air-fuel ratio in the previous cycle of the routine is on the richer side of the reference air-fuel ratio. If the detected exhaust gas air-fuel ratio in the previous cycle is richer than the reference air-fuel ratio, that is, if the detected exhaust gas air-fuel ratio has changed from the richer side to the leaner side of the reference air-fuel ratio, the process proceeds to step 202, in which a count value CF is incremented by "1". That is, the increment of the count value CF is started. Subsequently in step 203, the correction coefficient FAF1 is held at zero. The process then proceeds to step 213.

Conversely, if it is determined in step 201 that the detected exhaust gas air-fuel ratio in the previous cycle is on the leaner side of the reference air-fuel ratio, the process proceeds to step 204, in which it is determined whether the count value CF is greater than a set value C1 that represents the first set time D1. If CF≦C1, the process proceeds to step 202 and step 203 and then step 213. Conversely, if CF>C1, the process proceeds to step 205, in which the integral KR1 is added to the correction coefficient FAF1. Subsequently in step 206, the count value CF is cleared. Therefore, the correction coefficient FAF1 is fixed to zero until the first set time D1 elapses, as indicated in FIG. 9. After the first set time D1 elapses, the correction coefficient FAF1 is gradually increased.

If V>VR in step 200, the process proceeds to step 207, in which it is determined whether the detected exhaust gas air-fuel ratio in the previous cycle is on the leaner side of the reference air-fuel ratio. If the detected exhaust gas air-fuel ratio in the previous cycle is on the leaner side of the reference air-fuel ratio, that is, the detected exhaust gas has changed from the leaner side to the richer side of the reference air-fuel ratio, the process proceeds to step 208, in which the count value CF is incremented by "1". That is, the increment of the count value CF is started. Subsequently in step 209, the integral KR1 is added to the correction coefficient FAF1. The process then proceeds to step 213.

Conversely, if it is determined in step 207 that the detected exhaust gas air-fuel ratio in the previous cycle is on the richer side of the reference air-fuel ratio, the process proceeds to step 210. In step 210, it is determined whether the count value CF is greater than a set value C2 that represents the second set time D2. If CF≦C2, the process proceeds to step 208 and step 209 and then step 213. Conversely, if CF>C2, the process proceeds from step 210 to step 211, in which the correction coefficient FAF1 is fixed to zero. Subsequently in step 212, the count value CF is cleared. Therefore, the correction coefficient FAF1 is gradually increased until the second set time D2 elapses, as indicated in FIG. 9. After the second set time D2 elapses, the correction coefficient FAF1 is fixed to zero.

In step 213, the correction coefficient FAF2 is calculated (FAF2=a·sin (b×t+c). Subsequently in step 214, the feedback correction coefficient FAF is calculated (FAF=FAF1+FAF2).

Thus, in the embodiment, since the air-fuel ratio sensor 30 is disposed downstream of the NOx absorbent 12, the air-fuel ratio sensor 30 is prevented from contacting large amounts of HC. Therefore, false correction of the influent exhaust gas average air-fuel ratio is prevented. As a result, the influent exhaust gas average air-fuel ratio is controlled to its target value.

Figure 11:
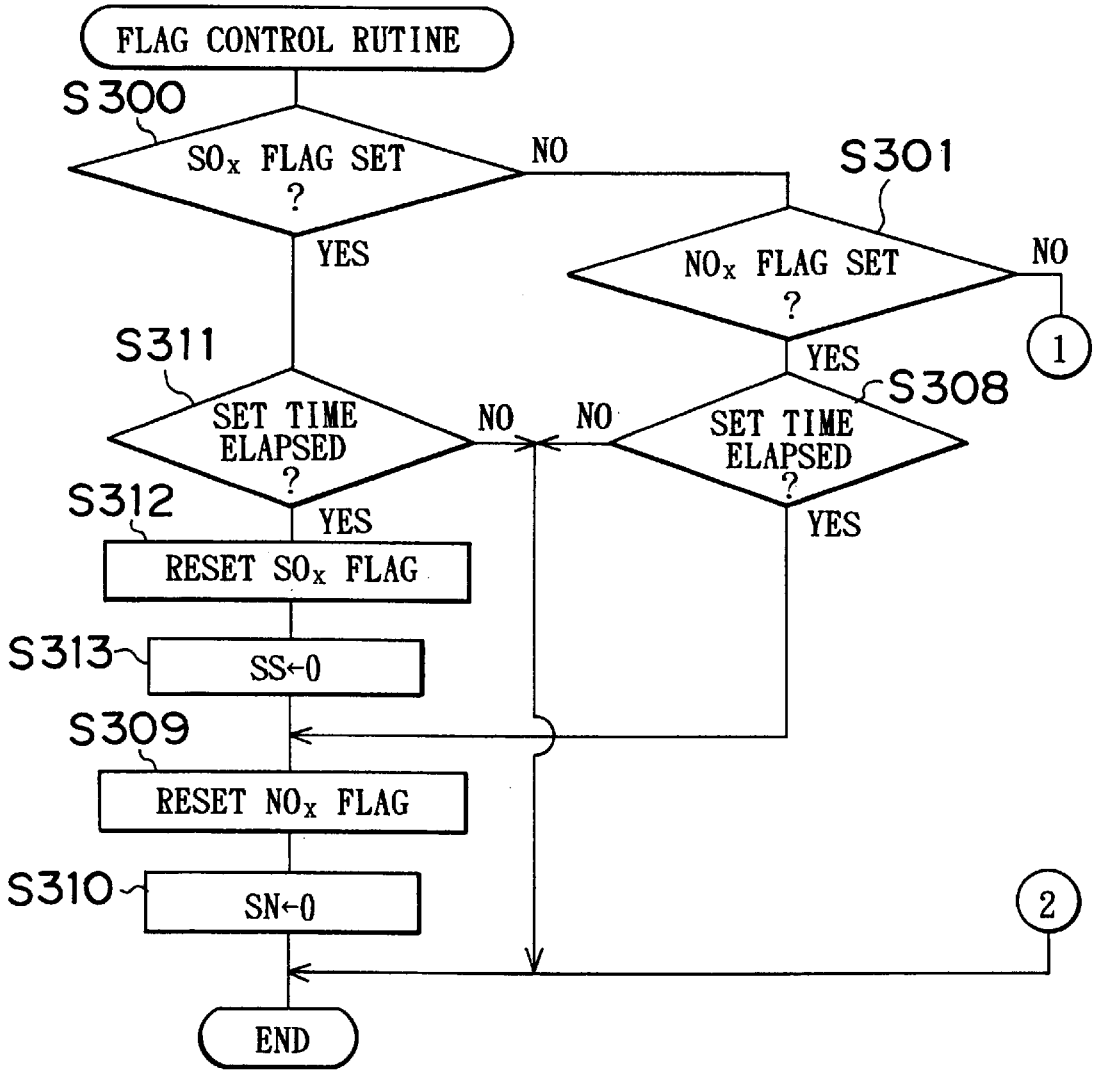
FIG. 11 is a flowchart illustrating a portion of the flag control routine.
Figure 12:
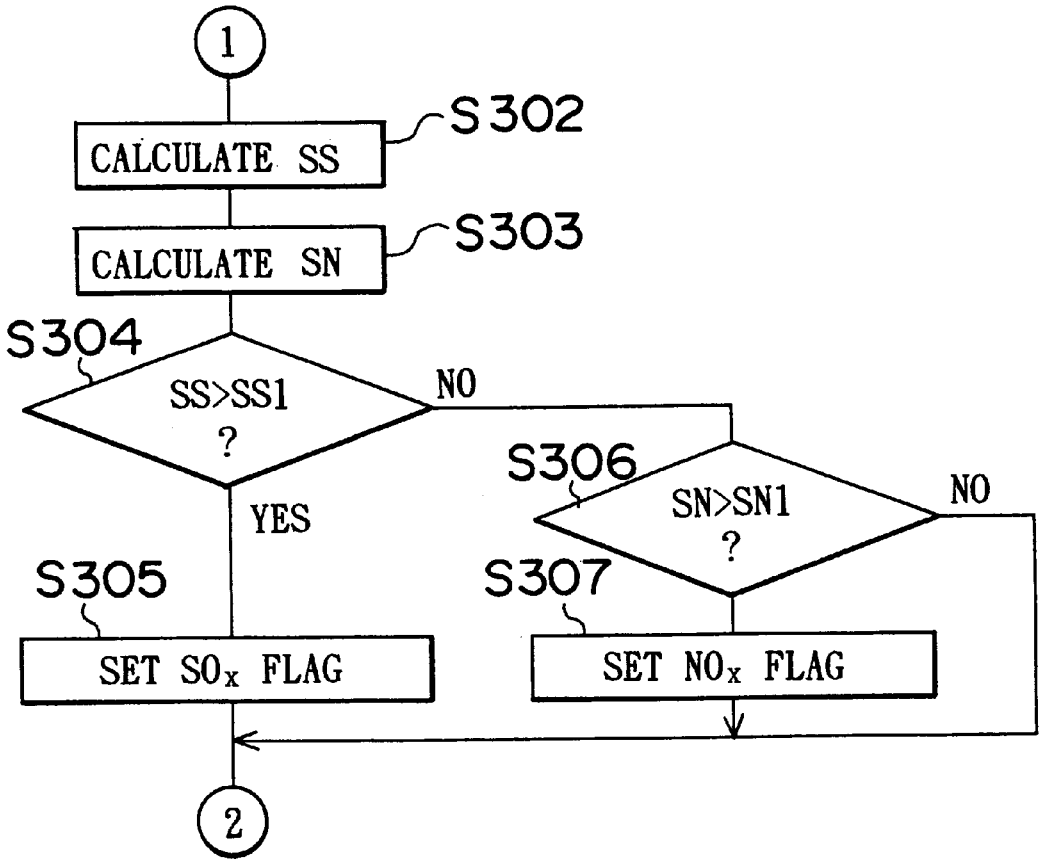
FIG. 12 is a flowchart illustrating the other portion of the flag control routine.

FIGS. 11 and 12 illustrate a flag control routine according to this embodiment. This routine is executed as a periodical interrupt at every predetermined set time. Referring to FIGS. 11 and 12, in step 300, it is determined whether a SOx flag is set. The SOx flag is a flag that is set when SOx needs to be released from the NOx absorbent 12 and that is reset in the other occasions. If the SOx flag is not set, the process proceeds to step 301, in which it is determined whether a NOx flag is set. The NOx flag is a flag that is set when NOx needs to be released from the NOx absorbent 12 and that is reset in the other occasions. If the NOx flag is not set, the process proceeds from step 301 to step 302 (FIG. 12), in which the amount SS of SOx absorbed in the NOx absorbent 12 is calculated based on, for example, an engine operation condition. Subsequently in step 303, the amount SN of NOx absorbed in the NOx absorbent 12 is calculated based on, for example, an engine operation condition. Subsequently in step 304, it is determined whether the amount SS of SOx absorbed is greater than a constant value SS1. If SS>SS1, the process proceeds to step 305, in which the SOx flag is set. Conversely, if SS≦SS1, the process proceeds to step 306, in which it is determined whether the amount SN of NOx absorbed in the NOx absorbent 12 is greater than a constant value SN1. If SN>SN1, the process proceeds to step 307, in which the NOx flag is set. Conversely, if SS≦SS1, the present cycle of the routine ends.

If it is determined in step 301 that the NOx flag is set, the process proceeds to step 308, in which it is determined whether a predetermined set time has elapsed following the setting of the NOx flag, that is, whether the release of NOx from the NOx absorbent 12 is completed. If the set time has not elapsed following the setting of the NOx flag, the present cycle ends. Conversely, if the set time has elapsed following the setting of the NOx flag, the process proceeds to step 309, in which the NOx flag is reset. Subsequently in step 310, the amount SN of NOx absorbed is cleared.

If it is determined in step 300 that the SOx flag is set, the process proceeds to step 311, in which it is determined whether a predetermined set time has elapsed following the setting of the SOx flag, that is, whether the release of SOx from the NOx absorbent 12 is completed. If the set time has not elapsed following the setting of the SOx flag, the present cycle of the routine ends. Conversely, if the set time has elapsed following the setting of the SOx flag, the process proceeds to step 312, in which the SOx flag is reset. Subsequently in step 313, the amount SS of SOx absorbed in cleared. Subsequently in steps 309 and 310, the NOx flag is reset, and the amount SN of NOx absorbed is cleared.

That is, when the influent exhaust gas average air-fuel ratio is shifted toward the richer side so as to release SOx from the NOx absorbent 12, NOx absorbed in the NOx absorbent 12 is also released therefrom. The time needed to complete the release of NOx from the NOx absorbent 12 is considerably shorter than the time needed to complete the release of SOx from the NOx absorbent 12. Therefore, by the time the release of SOx from the NOx absorbent 12 is completed, the release of NOx from the NOx absorbent 12 has already been completed. Hence, in the routine, when the release of SOx is completed, the NOx flag as well as the SOx flag is reset.

Figure 4:
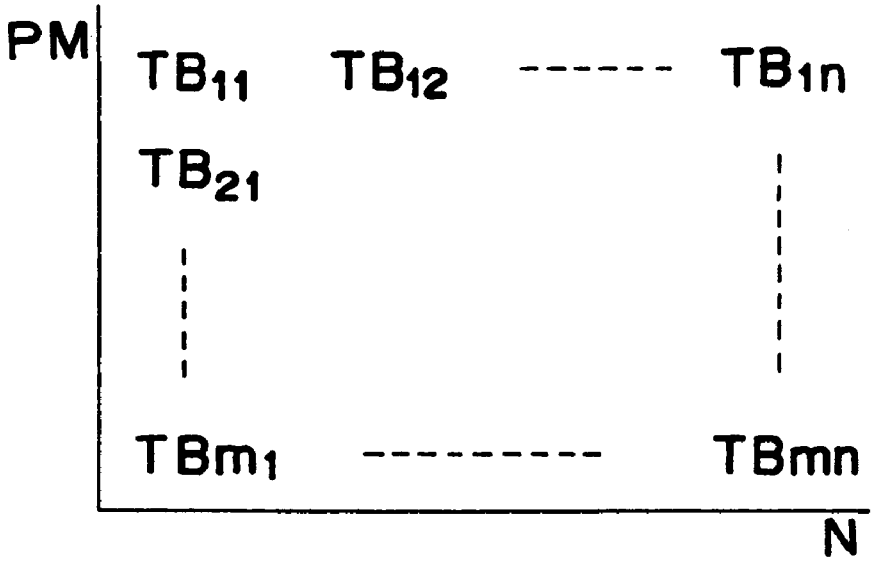
FIG. 4 is a diagram indicting a map of a basic fuel injection duration TB.
Figure 13:
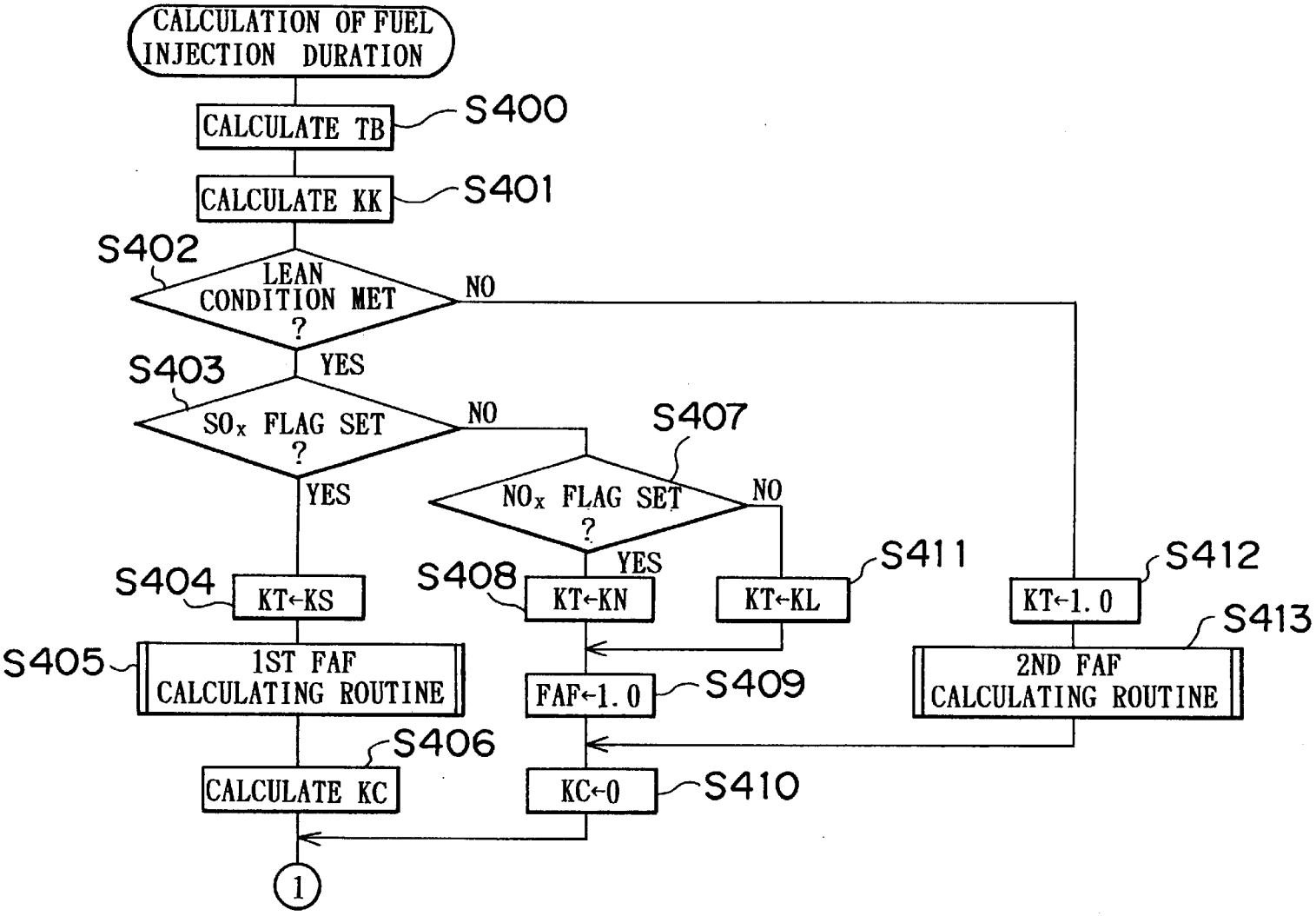
FIG. 13 is flowchart illustrating a portion of an operation for calculating a fuel injection duration.
Figure 14:
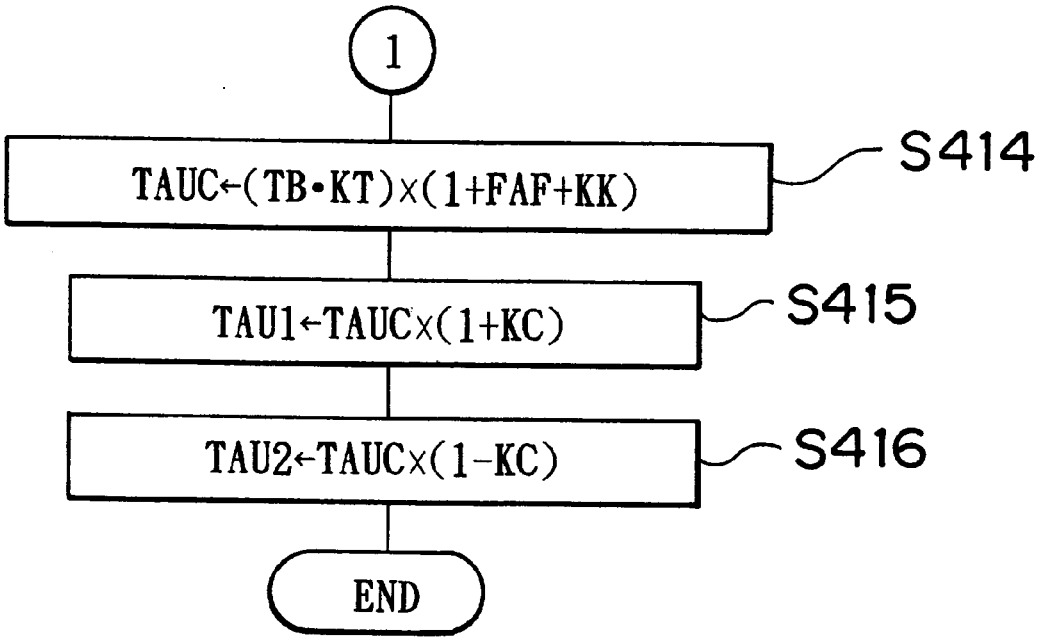
FIG. 14 is a flowchart illustrating the other portion of the fuel injection duration calculating operation.

FIGS. 13 and 14 illustrate a fuel injection duration calculating routine according to the embodiment. This routine is executed by an interrupt at every predetermined set crank angle. Referring to FIGS. 13 and 14, in step 400, a basic fuel injection duration TB is calculated from the map as indicated in FIG. 4. Subsequently in step 401, the correction coefficient KK is calculated. Subsequently in step 402, it is determined whether the lean condition is met. When the lean condition is met, the process proceeds to step 403, in which it is determined whether the SOx flag is set. If the SOx flag is set, the process proceeds to step 404, in which the target air-fuel ratio coefficient KT is stored as KS. Subsequently in step 405, the first FAF calculating routine illustrated in FIG. 10 is executed. Subsequently in step 406, the change coefficient KC is calculated from the map as indicated in FIG. 5. The process then proceeds to step 414 in FIG. 14.

If it is determined in step 403 that the SOx flag is not set, the process proceeds to step 407, in which it is determined whether the NOx flag is set. If the NOx flag is set, the process proceeds to step 408, in which the target air-fuel ratio coefficient KT is stored as KN. Subsequently in step 409, the feedback correction coefficient FAF is fixed to 1.0. Subsequently in step 410, the change coefficient KC is fixed to zero. The process then proceeds to step 414 in FIG. 14. If it is determined in step 407 that the NOx flag is not set, the process proceeds to step 411, in which the target air-fuel ratio coefficient KT is stored as KL. Subsequently in step 409, the feedback correction coefficient FAF is set to 1.0. After the change coefficient KC is fixed to zero in step 410, the process proceeds to step 414.

If it is determined in step 402 that the lean condition is not met, the process proceeds to step 412, in which the target air-fuel ratio coefficient KT is fixed to 1.0. Subsequently in step 413, the second FAF calculating routine illustrated in FIG. 7 is executed. Subsequently in step 410, the change coefficient KC is fixed to zero. The process then proceeds to step 414.

In step 414, the corrected fuel injection duration TAUC is calculated (TAUC=(TB KT)×(1+FAF+KK)). Subsequently in step 415, the fuel injection duration TAU1 of the first cylinder group 1*a* is calculated (TAU1=TAUC×(1+KC)). Subsequently in step 416, the fuel injection duration TAU2 of the second cylinder group 1*b* is calculated (TAU2=TAUC×(1−KC)).

In the foregoing embodiments, the air-fuel ratio of mixture to be burned in each cylinder is brought equal to the target value of the air-fuel ratio of exhaust gas from the cylinder. However, according to the invention, it is also possible to achieve a rich air-fuel ratio of exhaust gas from the first cylinder group while maintaining a lean air-fuel ratio of mixture to be burned in the first cylinder group, by performing the fuel injection twice during the expansion stroke or the exhaust stroke.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. An air-fuel ratio control apparatus for an internal combustion engine including a plurality of cylinders divided into a first cylinder group and a second cylinder group, the first and second cylinder groups being connected to a common confluent exhaust passage with an emission control catalyst device disposed therein, the air-fuel ratio control apparatus comprising:

first means for setting an influent target value of an average influent air-fuel ratio of exhaust gas flowing into the emission control catalyst device;

second means for setting a first group target value of a first group air-fuel ratio of exhaust gas from the first cylinder group to a value richer than the influent target value, and setting a second group target value of a second group air-fuel ratio of exhaust gas from the second cylinder group to a value leaner than the influent target value, and the second means setting the first group target value and the second group target value so that, when the first group air-fuel ratio and the second group air-fuel ratio are equal to the first group target value and the second group target value, respectivly, the average influent air-fuel ratio becomes equal to the influent target value;

third means for calculating a first amount of fuel to be injected to cylinders of the first cylinder group and a second amount of fuel to be injected to the cylinders of the second cylinder group so that the first group air-fuel ratio and the second group air-fuel ratio become equal to the first group target value and the second group target value, respectively;

an air-fuel ratio sensor disposed in a portion of the confluent exhaust passage extending downstream of the emission control catalyst device; and fourth means for correcting, based on an air-fuel ratio detected by the air-fuel ratio sensor, the first amount of fuel and the second amount of fuel so that the average influent air-fuel ratio becomes equal to the influent target value.

2. An air-fuel ratio control apparatus of an internal combustion engine according to claim 1, wherein the emission control catalyst device is formed by a NOx absorbent that absorbs NOx when the air-fuel ratio of exhaust gas flowing into the emission control catalyst device is leaner than a theoretical air-fuel ratio, and releases absorbed NOx when an oxygen concentration in exhaust gas flowing into the emission control catalyst device decreases, and wherein the influent target value is set to a value slightly richer than the theoretical air-fuel ratio.

3. An air-fuel ratio control apparatus of an internal combustion engine according to claim 2, further comprising:

fifth means for setting the first group target value and the second group target value to the theoretical air-fuel ratio; and sixth means for correcting, based on the air-fuel ratio detected by the air-fuel ratio sensor, the first amount of fuel and the second amount of through a feedback correction operation so that the first group air-fuel ratio and the second group air-fuel ratio become equal to the theoretical air-fuel ratio.

4. An air-fuel ratio control apparatus of an internal combustion engine according to claim 3, wherein the fourth means corrects the first amount of and the second amount of fuel through a feedback correction operation, and wherein an absolute value of a feedback gain of the fourth means is smaller than an absolute value of a feedback gain of the sixth means.

5. An air-fuel ratio control apparatus of an internal combustion engine according to claim 3, wherein the air-fuel ratio sensor detects whether the air-fuel ratio is richer or leaner than a predetermined reference air-fuel ratio, and wherein when a detected exhaust gas air-fuel ratio is leaner than the predetermined reference air-fuel ratio, the first amount of fuel and the second amount of fuel are subjected to an increasing correction, and when the detected exhaust gas air-fuel ratio is richer than the predetermined reference air-fuel ratio, the first amount of fuel and the second amount of fuel are subjected to a decreasing correction.

6. An air-fuel ratio control apparatus of an internal combustion engine according to claim 2, wherein the air-fuel ratio sensor detects whether the air-fuel ratio of exhaust gas is richer or leaner than a predetermined reference air-fuel ratio, and wherein when a detected exhaust gas air-fuel ratio is leaner than the predetermined reference air-fuel ratio, the first and second amounts of fuel are subjected to an increasing correction, and when the detected exhaust gas air-fuel ratio is richer than the predetermined reference air-fuel ratio, the increasing correction of the first and second amounts of fuel is prevented.

7. An air-fuel ratio control apparatus of an internal combustion engine according to claim 6, wherein the increasing correction of the first and second amounts of fuel is started after a predetermined first set time elapses following a switch of the detected exhaust gas air-fuel ratio from a richer side to a leaner side of the predetermined reference air-fuel ratio.

8. An air-fuel ratio control apparatus of an internal combustion engine according to claim 7, wherein the increasing correction of the first and second amounts of fuel is prevented after a predetermined second set time longer than the first set time elapses following a switch of the detected exhaust gas air-fuel ratio from the leaner side to the richer side of the predetermined reference air-fuel ratio.

9. An air-fuel ratio control apparatus of an internal combustion engine according to claim 6, wherein a correcting operation of the first and second amounts of fuel is stopped when the detected exhaust gas air-fuel ratio is on the richer side of the predetermined reference air-fuel ratio.

10. An air-fuel ratio control method for an internal combustion engine in which a plurality of cylinders are divided into first and second cylinder groups connected to a common confluent exhaust passage with an emission control catalyst device disposed therein, the control method comprising:

setting an influent target value of an average influent air-fuel ratio exhaust gas flowing into the emission control catalyst device;

setting a first group target value of a first group air-fuel ratio of exhaust gas from the first cylinder group to a value richer than the influent target value, and setting a second group target value of a second group air-fuel ratio of exhaust gas from the second cylinder group to a value leaner than the influent target value, and setting the first group and second group target so that when the first group and second group air-fuel ratios are equal to the first group and second group target values, respectivly, the average influent air-fuel ratio becomes equal to the influent target value;

calculating a first group amount of fuel to be injected to the first cylinder group and a second group amount of fuel to be injected to the second cylinder group so that the first group air-fuel ratio and the second group air-fuel ratio become equal to the first group and second group target values, respectively;

correcting the first group and second group amounts of fuel so that the average influent air-fuel ratio becomes equal to the influent target value, based on an air-fuel ratio detected by an air-fuel ratio sensor disposed in a portion of the confluent exhaust passage downstream of the emission control catalyst device.

11. An air-fuel ratio control method of an internal combustion engine according to claim 10, wherein the emission control catalyst device is formed by a NOx absorbent that absorbs NOx when the air-fuel ratio of exhaust gas flowing into the emission control catalyst device is leaner than a theoretical air-fuel ratio, and releases absorbed NOx when an oxygen concentration in exhaust gas flowing into the emission control catalyst device decreases, wherein the influent target value is set to a value slightly richer than the theoretical air-fuel ratio.

12. An air-fuel ratio control method of an internal combustion engine according to claim 11, further comprising:

setting the first group target value and the second group target value to the theoretical air-fuel ratio; and correcting, based on the air-fuel ratio detected by the air-fuel ratio sensor, the first amount of fuel and the second amount of through a first feedback correction operation so that the first group air-fuel ratio and the second group air-fuel ratio become equal to the theoretical air-fuel ratio.

13. An air-fuel ratio control method of an internal combustion engine according to claim 12, wherein the correction of the first group and second group amounts of fuel that the average influent air-fuel ratio becomes equal to the influent target value is performed through a second feedback correction operation, and wherein an absolute value of a feedback gain of the first feedback correction operation is smaller than an absolute value of a feedback gain of the second feedback correction operation.

14. An air-fuel ratio control method of an internal combustion engine according to claim 12, wherein the air-fuel ratio sensor detects whether the air-fuel ratio is richer or leaner than a predetermined reference air-fuel ratio, and wherein when a detected exhaust gas air-fuel ratio is leaner than the predetermined reference air-fuel ratio, the first amount of fuel and the second amount of fuel are subjected to an increasing correction, and when the detected exhaust gas air-fuel ratio is richer than the predetermined reference air-fuel ratio, the first amount of fuel and the second amount of fuel are subjected to a decreasing correction.

15. An air-fuel ratio control method of an internal combustion engine according to claim 11, wherein the air-fuel ratio sensor detects whether the air-fuel ratio of exhaust gas is richer or leaner than a predetermined reference air-fuel ratio, and wherein when a detected exhaust gas air-fuel ratio is leaner than the predetermined reference air-fuel ratio, the first and second amounts of fuel are subjected to an increasing correction, and when the detected exhaust gas air-fuel ratio is richer than the predetermined reference air-fuel ratio, the increasing correction of the first and second amounts of fuel is prevented.

16. An air-fuel ratio control method of an internal combustion engine according to claim 15, wherein the increasing correction of the first and second amounts of fuel is started after a predetermined first set time elapses following a switch of the detected exhaust gas air-fuel ratio from a richer side to a leaner side of the predetermined reference air-fuel ratio.

17. An air-fuel ratio control method of an internal combustion engine according to claim 16, wherein the increasing correction of the first and second amounts of fuel is prevented after a predetermined second set time longer than the first set time elapses following a switch of the detected exhaust gas air-fuel ratio from the leaner side to the richer side of the predetermined reference air-fuel ratio.

18. An air-fuel ratio control apparatus of an internal combustion engine according to claim 15, wherein a correcting operation of the first and second amounts of fuel is stopped when the detected exhaust gas air-fuel ratio is on the richer side of the predetermined reference air-fuel ratio.

19. An air-fuel ratio control apparatus for an internal combustion engine including a plurality of cylinders divided into a first cylinder group and a second cylinder group, the first and second cylinder groups being connected to a common confluent exhaust passage with an emission control catalyst device disposed therein, the air-fuel ratio control apparatus comprising:

an air-fuel ratio sensor disposed in a portion of the confluent exhaust passage extending downstream of the emission control catalyst device; and a control system that sets an influent target value of an average influent air-fuel ratio of exhaust gas flowing into the emission control catalyst device, sets a first group target value of a first group air-fuel ratio of exhaust gas from the first cylinder group to a value richer than the influent target value, and sets a second group target value of a second group air-fuel ratio of exhaust gas from the second cylinder group to a value leaner than the influent target value, and the second means setting the first group target value and the second group target value so that, when the first group air-fuel ratio and the second group air-fuel ratio are equal to the first group target value and the second group target value, respectivly, the average influent air-fuel ratio becomes equal to the influent target value, calculates a first amount of fuel to be injected to cylinders of the first cylinder group and a second amount of fuel to be injected to the cylinders of the second cylinder group so that the first group air-fuel ratio and the second group air-fuel ratio become equal to the first group target value and the second group target value, respectively, and corrects, based on an air-fuel ratio detected by the air-fuel ratio sensor, the first amount of fuel and the second amount of fuel so that the average influent air-fuel ratio becomes equal to the influent target value.

20. An air-fuel ratio control apparatus of an internal combustion engine according to claim 19, wherein the emission control catalyst device is formed by a NOx absorbent that absorbs NOx when the air-fuel ratio of exhaust gas flowing into the emission control catalyst device is leaner than a theoretical air-fuel ratio, and releases absorbed NOx when an oxygen concentration in exhaust gas flowing into the emission control catalyst device decreases, and wherein the influent target value is set to a value slightly richer than the theoretical air-fuel ratio.

* * * * *